US010500644B2

(12) United States Patent
Ozaki et al.

(10) Patent No.: US 10,500,644 B2
(45) Date of Patent: Dec. 10, 2019

(54) METHOD FOR PRODUCING NICKEL POWDER HAVING LOW CARBON CONCENTRATION AND LOW SULFUR CONCENTRATION

(71) Applicant: SUMITOMO METAL MINING CO., LTD., Tokyo (JP)

(72) Inventors: Yoshitomo Ozaki, Niihama (JP); Shin-ichi Heguri, Niihama (JP); Kazuyuki Takaishi, Niihama (JP); Osamu Ikeda, Niihama (JP); Hideki Ohara, Niihama (JP); Tomoaki Yoneyama, Niihama (JP); Yohei Kudo, Niihama (JP)

(73) Assignee: Sumitomo Metal Mining Co., Ltd. (JP)

( * ) Notice: Subject to any disclaimer, the term of this patent is extended or adjusted under 35 U.S.C. 154(b) by 330 days.

(21) Appl. No.: 15/303,557

(22) PCT Filed: Apr. 13, 2015

(86) PCT No.: PCT/JP2015/061358
§ 371 (c)(1),
(2) Date: Oct. 12, 2016

(87) PCT Pub. No.: WO2015/159846
PCT Pub. Date: Oct. 22, 2015

(65) Prior Publication Data

US 2017/0043403 A1 Feb. 16, 2017

(30) Foreign Application Priority Data

Apr. 15, 2014 (JP) ..... 2014-083886
Aug. 20, 2014 (JP) ..... 2014-167904

(51) Int. Cl.
*B22F 9/26* (2006.01)
*B22F 9/24* (2006.01)
(Continued)

(52) U.S. Cl.
CPC ..... *B22F 9/24* (2013.01); *B22F 1/0003* (2013.01); *B22F 9/26* (2013.01); *C22C 19/03* (2013.01);
(Continued)

(58) Field of Classification Search
None
See application file for complete search history.

(56) References Cited

U.S. PATENT DOCUMENTS 2,734,821 A * 2/1956 Schaufelberger ..... B22F 9/26 75/371
3,816,098 A 6/1974 Mackiw et al.
(Continued)

FOREIGN PATENT DOCUMENTS

JP 49-74160 7/1974
JP 2003-514111 4/2003
(Continued)

OTHER PUBLICATIONS

"Hydrogen as a Reducing Agent: State-of-the-Art Science and Technology:" by Stefan Luidold et al. Jun. 2007. pp. 20-26.
(Continued)

*Primary Examiner* — George Wyszomierski
(74) *Attorney, Agent, or Firm* — Gerald E. Hespos; Michael J. Porco; Matthew T. Hespos

(57) ABSTRACT

Provided a production method for reducing the content level of sulfur and carbon which are impurities in nickel powder to improve the quality of nickel powder produced by a complexing reduction method. The method of producing nickel powder having low carbon and sulfur concentrations
(Continued)

includes: a complexing treatment of adding a complexing agent to a nickel sulfate aqueous solution to form a solution containing nickel complex ions; maintaining the solution containing nickel complex ions at a solution temperature of 150 to 250° C. in a pressure vessel and blowing hydrogen gas into the solution containing nickel complex ions to perform hydrogen reduction to produce nickel powder; washing the nickel powder with water; and then roasting the nickel powder washed with water in a mixed gas atmosphere of nitrogen and hydrogen.

4 Claims, 1 Drawing Sheet

(51) Int. Cl.
*C22C 19/03* (2006.01)
*B22F 1/00* (2006.01)

(52) U.S. Cl.
CPC ..... *B22F 2009/245* (2013.01); *B22F 2301/15* (2013.01)

(56) References Cited

U.S. PATENT DOCUMENTS

| | | | | |
|---|---|---|---|---|
| 3,914,124 | A | 10/1975 | O'Neill | |
| 5,584,908 | A | 12/1996 | Scheie | |
| 2004/0033894 | A1* | 2/2004 | Hajmrle | B01J 23/14 502/302 |
| 2013/0074653 | A1 | 3/2013 | Kobayashi et al. | |

FOREIGN PATENT DOCUMENTS

| | | |
|---|---|---|
| JP | 2010-509213 | 3/2010 |
| JP | 2012-31446 | 2/2012 |
| WO | 01/32945 | 5/2001 |
| WO | 2008/001741 | 1/2008 |

OTHER PUBLICATIONS

European Search Report dated Dec. 8, 2017.
"The manufacture and properties of Metal powder produced by the gaseous reduction of aqueous solutions", Powder metallurgy, No. 1/2 (1958), pp. 40-52.
International Search Report of Jul. 14, 2015.

* cited by examiner

METHOD FOR PRODUCING NICKEL POWDER HAVING LOW CARBON CONCENTRATION AND LOW SULFUR CONCENTRATION

BACKGROUND

1. Field of the Invention

The present invention relates to a method for producing a nickel powder with reduced impurities, particularly carbon and sulfur from nickel powder produced from a nickel solution by a complexing reduction method.

2. Description of the Related Art

Examples of the methods for smelting nickel include: a method of roasting ore into the form of a sulfide or an oxide and reducing the sulfide or the oxide to obtain ferronickel which is an alloy with iron and used as a raw material for stainless steel; and a method of separating impurities from acid-dissolved solution in which a sulfide is dissolved in hydrochloric acid or sulfuric acid and performing electrowinning to obtain electric nickel. Further, a nickel salt such as nickel sulfate and nickel chloride may be recovered from the acid-dissolved solution and used for plating, a battery material, and the like.

In addition, examples of the methods for producing nickel in a powder state from a nickel salt include a wet process shown in "The manufacture and properties of Metal powder produced by the gaseous reduction of aqueous solutions", Powder metallurgy, No. 1/2 (1958), pp 40-52.

The method of "The manufacture and properties of Metal powder produced by the gaseous reduction of aqueous solutions", Powder metallurgy, No. 1/2 (1958), pp 40-52 is a so-called complexing reduction method including: mixing a complexing agent with a nickel sulfate aqueous solution to be subjected to complexing treatment to form a nickel ammine complex solution, putting the solution in a pressure vessel, sealing the vessel, heating the solution to about 150 to 250° C. followed by maintaining the temperature, and blowing hydrogen gas into the solution, in which the nickel ammine complex is reduced by hydrogen to produce nickel powder.

Further, when nickel powder is used as a paste and a positive electrode active material of a nickel-hydrogen battery and the like, impurity elements such as carbon and sulfur may cause the generation of gas. Therefore, the reduction of impurity elements is required.

Therefore, in order to remove sulfur and carbon, a method of heat treatment has been proposed. For example, Japanese Patent Laid-Open No. 2012-31446 discloses a method for producing a ferronickel raw material from a nickel sulfide or a mixed sulfide containing nickel and cobalt, obtained by hydrometallurgy of nickel oxide ore or obtained from scraps or products in process.

Specifically, the ferronickel raw material from which sulfur is separated is obtained through the following steps:

(1) a redissolution step, wherein a nickel sulfide or a mixed sulfide of nickel sulfide and cobalt sulfide is made into a slurry, and an oxidizing agent is added to the slurry to obtain a concentrate containing nickel when the nickel sulfide is dissolved, or a concentrate containing nickel and cobalt when the mixed sulfide is dissolved; (2) a deferrization step, wherein an alkali is added to the concentrate obtained in the redissolution step to obtain a neutralized precipitate and a post-neutralization solution; (3) a solvent extraction step, wherein the post-neutralization solution obtained in the deferrization step is mixed with an organic extractant to be separated into an extraction organic and a raffinate, and then a back-extraction solution and a back-extracted organic are obtained from the extraction organic; (4) a hydroxylation step, wherein alkali is added to the raffinate obtained in the solvent extraction step and mixed to form nickel hydroxide; (5) a roasting step, wherein the nickel hydroxide obtained in the hydroxylation step is heated and roasted in a temperature range of not less than 230° C. and not more than 870° C. to form nickel oxide; and (6) a washing and calcining step, wherein the nickel oxide obtained in the roasting step is water-washed with water at a temperature of not less than 50° C., and then calcined at a temperature of not less than 50° C. to form a washed nickel oxide.

However, unlike the method for producing a ferronickel raw material described in Japanese Patent Laid-Open No. 2012-31446 in which impurities such as carbon and sulfur are removed by heat treatment, although impurities such as sulfur and carbon can be removed by heat treatment in the case of nickel powder, even the nickel powder is simultaneously oxidized or sintered to be coarsened. Therefore, nickel powder in a desired form cannot be produced, and the sintering of nickel powder is not preferred in terms of cost since new facilities for crushing and the like are required.

Thus, a method suitable for effectively separating sulfur and carbon from nickel while avoiding the influence on the properties of nickel powder has not been found.

In order to improve the quality of nickel powder produced by a complexing reduction method, the present invention provides a production method for reducing the content level of sulfur and carbon which are impurities in nickel powder.

SUMMARY

In order to solve the above problem, the present invention intends to separate sulfur and carbon by washing and roasting nickel powder produced from a nickel solution using a complexing reduction method.

The first aspect of the present invention is a method of producing nickel powder having low carbon and sulfur concentrations, the method sequentially including: a complexing treatment of adding a complexing agent to a nickel sulfate aqueous solution to prepare a solution containing nickel complex ions; a hydrogen reduction treatment of charging the solution containing nickel complex ions in a pressure vessel, maintaining at a solution temperature of 150 to 250° C., and blowing hydrogen gas into the solution containing nickel complex ions to perform hydrogen reduction to produce nickel powder; a water-washing treatment of washing the nickel powder with water of which amount is at least equal to and at most 5 times larger than a weight of the nickel powder at a solution temperature of 50 to 90° C., or of subjecting a mixture of the nickel powder and water to ultrasonic washing under low pressure, to thereby produce nickel powder having reduced the content levels of carbon and sulfur; and a roasting treatment of roasting the nickel powder washed with water in a mixed gas atmosphere of nitrogen and hydrogen that has the concentration of 2 to 4% by weight.

The second aspect of the present invention is a method of producing nickel powder having low carbon and sulfur concentrations according to the first aspect, wherein the hydrogen concentration in the mixed gas in the roasting treatment is 2 to 4% by weight.

The third aspect of the present invention is a method of producing nickel powder having low carbon and sulfur concentrations according to the first and second aspects, wherein the temperature during the roasting treatment is 700° C. or more and 1250° C. or less.

The present invention can effectively remove carbon and sulfur as impurity elements from nickel powder produced by a complexing reduction method, greatly improving the quality of nickel powder. Thus, an industrially remarkable effect can be achieved.

DETAILED DESCRIPTION

The present invention enables a reduction in impurity concentration in nickel powder, which has been difficult until now, by using a mixed gas of hydrogen and nitrogen as the atmosphere of roasting, maintaining the specific surface area of particles, and providing a washing step.

Hereinafter, the production method of the present invention will be described with reference to the drawings.

Figure 1:
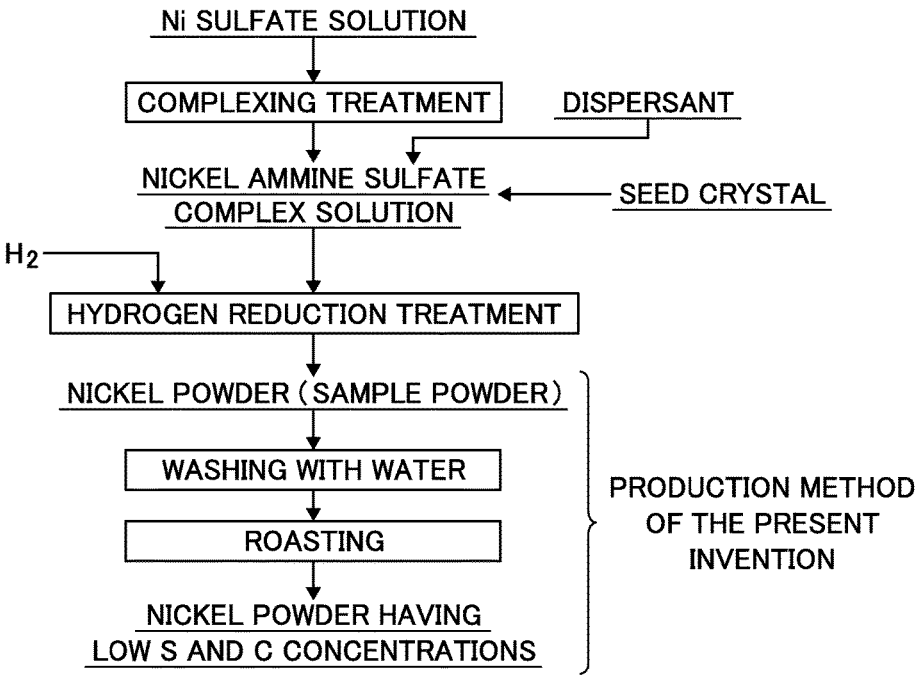
FIG. 1 is a production flow chart of nickel powder of the present invention.

FIG. 1 a production flow chart showing the method for producing nickel powder of the present invention.

The present invention is characterized by removing impurities, particularly carbon and sulfur, contained in nickel powder prepared by a complexing reduction method from the nickel powder. First, the nickel powder used as sample powder is nickel powder prepared through "complexing treatment" and "hydrogen reduction treatment", which are described as the upstream steps of FIG. 1.

The nickel sample powder by hydrogen reduction is prepared by adding ammonia as a complexing agent and a dispersant to a solution containing nickel, performing complexing treatment to form a slurry containing nickel complex ions such as a "nickel ammine sulfate complex" and then performing hydrogen reduction by blowing hydrogen gas into the slurry while maintaining the slurry under a high temperature and high pressure of 150 to 250° C. to reduce the nickel complex ions in the slurry. A conventionally known method may be used as the specific method. Furthermore, nickel powder, iron powder, or the like may be added as seed crystals.

The feature of the present invention lies in a production method of removing, from the nickel powder obtained as described above, impurities, particularly carbon and sulfur, contained in the powder.

As shown in FIG. 1, the method of removing a carbon and a sulfur component as impurities from the nickel powder according to the present invention sequentially includes: a "washing step" of subjecting sample powder to washing treating with water to remove water-solubles from the impurities; and a "roasting step" of separating remaining carbon and sulfur which have not been removed in the "washing step" by performing roasting treatment at high temperatures, thereby reducing the impurity concentration in the resulting nickel powder to produce high purity nickel powder.

Therefore, the "washing step" and the "roasting step", which are the features of the present invention, will be described in detail below.

[Washing Step]

This is a step of washing nickel powder as sample powder by a predetermined method to obtain nickel powder in which the concentration of water-soluble impurities is reduced.

Specific washing methods that can be used include various methods such as poured water over nickel powder and increasing the water temperature to about 90° C. Further, washing in an atmosphere of applying ultrasonic waves is also effective.

Further, the amount of washing water may be at least equal to and at most 5 times larger, preferably at most 3 times larger than the amount of nickel to be washed, by weight ratio. If the amount of washing water is less than the amount of the nickel, the amount of washing water may be insufficient, and the removal of carbon and sulfur may be imperfect. Further, even if washing water is used in an amount more than 5 times larger, washing effect will not be improved and water resources will only be wasted, which is not preferred.

[Roasting Step]

This is a step of roasting, at high temperatures, the nickel powder from which most of water-soluble sulfur and carbon have been removed in the washing step to thereby separate remaining sulfur and carbon to obtain high purity nickel powder.

The present invention has been completed by finding that sulfur and carbon can be effectively removed, not by using an oxidizing atmosphere or a perfect inert atmosphere, but in a reducing atmosphere containing a very small amount of hydrogen gas, as the atmosphere in the roasting step.

In the atmosphere in the roasting step of the present invention, the concentration of hydrogen gas in an inert atmosphere such as nitrogen needs to be 2 to 4% by weight, and if it is less than 2% by weight, the reaction will be slow, and sufficient reduction effect will not be obtained. Further, if the concentration is more than 4% by weight, the reducing power will be too strong, which is not preferred.

Further, the roasting temperature may be 700° C. or more and 1250° C. or less, preferably 1000° C. or less.

However, if the temperature is less than 700° C., separation of carbon and sulfur will be insufficient. On the other hand, although the separation efficiently advances as the roasting temperature increases, the separation will hardly increase even if roasting is performed at a temperature of higher than 1000° C. Particularly, a roasting temperature of higher than 1250° C. is not preferred because sintering of nickel powder advances, which, for example, reduces the solubility of nickel powder in the applications in which nickel powder is dissolved in an acid.

EXAMPLES

Hereinafter, the present invention will be described in detail with reference to Examples.

Example 1

[Production of Nickel Powder (Sample Powder)]

A batch type autoclave having a capacity of 3 L was used as an experimental device. A solution containing 672 g of reagent grade nickel sulfate hexahydrate (corresponding to 150 g of pure nickel) and 660 g of ammonium sulfate in 880 ml of pure water was prepared; thereto was added 382 ml of 25% aqueous ammonia; the total volume of the resulting solution was adjusted to 2000 ml, which was used as a starting solution; and an inner cylinder of the above autoclave was charged with the starting solution.

Next, to the starting solution, were added 15 g of commercially available nickel powder as seed crystals and 0.8 g of sodium lignosulfonate as a dispersant to form a slurry. The inner cylinder containing the slurry was charged into a predetermined position of the autoclave, and the autoclave was sealed. The additive rate of seed crystals will be 10 (15/150×100=10) percent by weight.

Next, the slurry in the inner cylinder was heated to a solution temperature of 185° C. using a heat medium heater with stirring at 750 rpm using an electric stirrer.

From the time point when the solution temperature reached 185° C., hydrogen gas in a gas cylinder was blown into the slurry at a flow rate of 4.0 l/min, and the internal pressure was increased to 3.5 MPa, which was maintained to cause hydrogen reduction reaction.

The reaction was performed for 60 minutes after hydrogen gas blowing was started; the feed of hydrogen gas was stopped after a lapse of 60 minutes; and the slurry was then cooled to room temperature with stirring.

The cooled inner cylinder was removed from the autoclave, and the slurry in the inner cylinder was subjected to solid-liquid separation using filter paper and a nutsche to recover nickel powder prepared by a complexing reduction method.

The weight of the recovered nickel powder was about 140 g. In this regard, the rate of reduction calculated by dividing the amount of nickel powder by the amount of nickel contained in the charged nickel sulfate solution was about 83%.

[Washing Step]

Next, the prepared nickel powder was used as sample powder, and the powder was divided into 5 samples each having a weight of 10 g.

Next, each of the divided nickel powder was put on filter paper, and pure water at a solution temperature of 50° C. was poured over each sample as poured water while sucking the filter paper with a vacuum pump, wherein the amount of the poured water was changed to 100 ml, 75 ml, 50 ml, 30 ml, and 10 ml to wash the nickel powder with water.

After water washing, each nickel powder was taken on a watch glass and dried overnight in a vacuum dryer to prepare nickel powder having reduced impurities.

Figure 2:
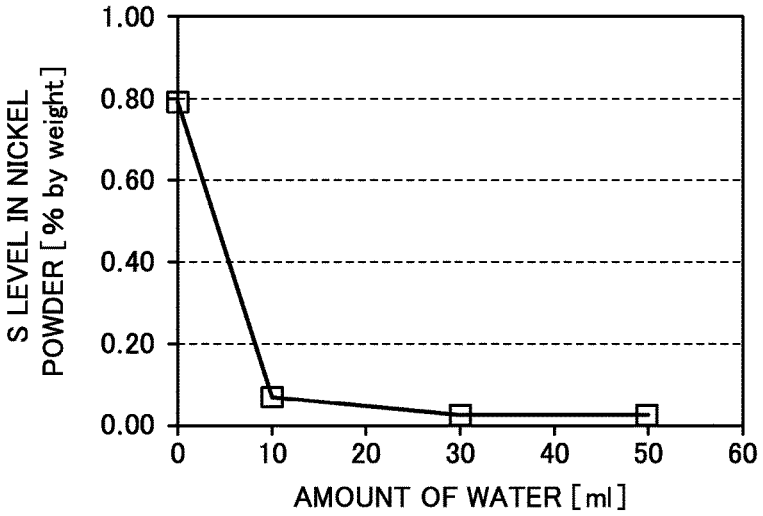
FIG. 2 is a view showing the change of the sulfur level in nickel powder versus the amount of poured water in the washing step in Example 1.

As a result of analyzing each prepared nickel powder by ICP, the nickel powder had a sulfur level of 0.8% by weight before washing, and the sulfur level of each nickel powder was reduced to less than 0.1% by weight after washing, as shown in FIG. 2. Note that the sulfur level in the case of having added 100 ml of water and in the case of having added 75 ml of water was the same level as in the case of having added 50 ml of water.

[Roasting Step]

Next, a sample having a sulfur level of 0.04% by weight, which was obtained by washing with 50 ml of poured water in the washing step, was divided into 4 samples each having a weight of 10 g. Each sample was molded into the shape of a straw bag having a size of 10×15×20 mm using a commercially available briquette machine (BGS-IV, manufactured by Shinto Kogyo K.K.). Next, the resulting molded article was set in a tubular furnace having an inside diameter of 60 mm, and thereto was fed, from a gas cylinder, high purity nitrogen gas at a flow rate of 960 ml/min to completely replace air in the tubular furnace with nitrogen.

After the replacement, the temperature in the tubular furnace was increased to and maintained at 700° C., 1000° C., 1200° C., and 1300° C., respectively.

After reaching each temperature, the temperature was maintained for 1 hour while feeding hydrogen gas and nitrogen gas from each gas cylinder into the tubular furnace at a flow rate of 40 ml/min and 960 ml/min, respectively, wherein the nitrogen gas was the same nitrogen gas as that used for replacement. The concentration of hydrogen gas in the fed gas is 3% by weight.

Nitrogen gas and hydrogen gas were fed for a predetermined period of time. Then, the power was turned off, and the furnace was naturally cooled until the temperature in the furnace decreased to 70° C. while feeding only nitrogen as the feed gas at a flow rate of 960 ml/min, wherein the nitrogen is the same nitrogen used at the heating.

The tubular furnace was opened when the temperature in the furnace decreased to less than 70° C., and nickel powder therein was removed and analyzed by ICP.

According to the analysis results, the sulfur level, which was 0.8% by weight in the sample powder before washing, was reduced to 0.04% by weight in the washing step, reduced to 0.02% by weight by passing through the roasting step at 700° C., and further reduced to 0.01% by weight by roasting at 1000° C.

With regard also to the carbon level, the carbon content, which was 0.20% by weight in the sample powder before washing, was reduced to 0.07% by weight after the washing step, reduced to 0.05% by weight by roasting at 700° C., and reduced to 0.02% by weight by roasting at 1000° C. Although the roasting at 1200° C. resulted in the same level as in the case of roasting at 1000° C., nickel powder was slightly sintered with each other, and the sintered powder required for cracking. Further, in the case of roasting at 1300° C., nickel powder was firmly sintered with each other, and the sintered powder was not suitable for the applications in which the powder needs to be dissolved.

Table 1 shows the change of the sulfur level and the carbon level in Example 1.

TABLE 1

| | Sulfur and carbon levels of sample powder*[1] | | Sulfur and carbon levels after washing step | | Sulfur and carbon levels after roasting step | | | |
|---|---|---|---|---|---|---|---|---|
| | | | | | 700° C. | | 1000° C. | |
| | S | C | S | C | S | C | S | C |
| Example 1 | 0.80 | 0.20 | 0.04 | 0.07 | 0.02 | 0.05 | 0.01 | 0.02 |

*[1]Hydrogen-reduced nickel powder
Unit of level: % by weight

As shown in Table 1, 95% of sulfur contained in the sample powder can be reduced by performing the washing step of the present invention, and the effect is large. With regard also to carbon, 65% of carbon can be reduced in the washing step. Thus, most of the reduction of sulfur and carbon in the present invention has been obtained in the washing step.

Therefore, the following Examples were performed for grasping further effect of the washing step.

Example 2

[Production of Sample Powder]

Ten grams of nickel powder produced using hydrogen gas in the same manner as in Example 1 was divided and used as sample powder. The nickel powder had a sulfur level of 0.75% by weight and a carbon level of 0.06% by weight.

[Washing Step]

Next, the nickel powder was put into a beaker having a capacity of 100 ml, and thereto was added 50 ml of pure water at 90° C. Subsequently, the mixture was stirred at a number of revolution of 400 rpm for 1 hour while keeping the solution temperature at 90° C. using a stirrer and a heater.

After the completion of stirring, the nickel powder was filtered with filter paper and dried in the same vacuum dryer as in Example 1.

When sulfur and carbon in the nickel powder were analyzed, it was observed that the sulfur level was reduced to 0.05% by weight and carbon level was reduced to 0.02% by weight.

Table 2 shows the change of the sulfur level and the carbon level in Example 2.

TABLE 2

| | Sulfur and carbon levels of sample powder*[1] | | Sulfur and carbon levels after washing step and drying | |
|---|---|---|---|---|
| | S | C | S | C |
| Example 2 | 0.75 | 0.06 | 0.05 | 0.02 |

*[1]Hydrogen-reduced nickel powder
Unit of level: % by weight

Example 3

[Washing Step]

Nickel powder which was subjected to hydrogen reduction in the same manner as in Example 1 was used as sample powder. The nickel powder was washed with water in the same manner as in Example 1, and 5 g of the nickel powder after the washing step was divided. The sulfur level of the nickel powder was reduced from 0.8% by weight to 0.03% by weight, and the carbon level was also reduced from 0.10% by weight to 0.04% by weight.

Further, the same nickel powder as sample powder was put into a flask which can be sucked, and thereto was added 200 ml of pure water at 25° C. Then, the inner part of the flask was sucked with a vacuum pump for 5 minutes, and the flask in which the inner part thereof is in a low pressure state was put into an ultrasonic washing machine and maintained for 3 minutes.

The operation of suction by a vacuum pump followed by ultrasonic washing was repeated 4 times.

The nickel powder obtained by the above washing was filtered with filter paper, taken on a watch glass, and dried with a vacuum dryer overnight.

When the nickel powder after drying was analyzed by ICP, it was observed that the sulfur level was reduced to 0.02% by weight from the initial sulfur level of 0.8% by weight, and the carbon level was also reduced to 0.02% by weight from the initial level of 0.10% by weight.

Table 3 shows the change of the sulfur level and the carbon level in Example 3.

TABLE 3

| | Sulfur and carbon levels of sample powder*[1] | | Sulfur and carbon levels after washing step | | Sulfur and carbon levels after drying | |
|---|---|---|---|---|---|---|
| | S | C | S | C | S | C |
| Example 3 | 0.80 | 0.10 | 0.03 | 0.04 | 0.02 | 0.02 |

*[1]Hydrogen-reduced nickel powder
Unit of level: % by weight

As apparent from Tables 2 and 3, the sulfur reduction effect in the washing step was more than 90 percent, which was the same as in Example 1. Further, with regard also to the carbon reduction effect, a reduction effect of more than 60 percent was obtained. Thus, it is found that the washing step according to the present invention is extremely effective in the reduction of sulfur and carbon contained in sample powder.

The invention claimed is:

1. A method of producing nickel powder having low carbon and sulfur concentrations, the method sequentially comprising:

a complexing treatment of adding a complexing agent to a nickel sulfate aqueous solution to prepare a solution containing nickel complex ions;

a hydrogen reduction treatment of charging the solution containing nickel complex ions in a pressure vessel, maintaining the solution at a solution temperature of 150 to 250° C., and blowing hydrogen gas into the solution containing nickel complex ions to perform hydrogen reduction to produce nickel powder;

a water-washing treatment of washing the nickel powder with water of which amount is at least equal to and at most 5 times larger than a weight of the nickel powder at a solution temperature of 50 to 90° C., or of subjecting a mixture of the nickel powder and water to ultrasonic washing at atmospheric pressure or below, to thereby produce nickel powder having a content level of sulfur reduced by 95% from the content level of sulfur in the nickel powder obtained in the hydrogen reduction treatment and having a content level of carbon reduced by 65% from the content level of the carbon in the nickel powder obtained in the hydrogen reduction treatment; and a roasting treatment of roasting the nickel powder washed with water in a mixed gas atmosphere of hydrogen having a concentration of 2 to 4% by weight and nitrogen, and thereby causing the content level of the sulfur to be reduced further from the content level of the sulfur obtained in the water-washing treatment and causing the content level of the carbon to be reduced further from the content level of the carbon obtained in the water-washing treatment nickel.

2. The method of producing nickel powder having low carbon and sulfur concentrations according to claim 1, wherein a temperature during the roasting treatment is 700° C. or more and 1250° C. or less.

3. The method of producing nickel powder having low carbon and sulfur concentrations according to claim 1, wherein the roasting treatment is carried out so that the content level of sulfur is reduced by at least 50% from the content level of sulfur in the nickel powder obtained in the water-washing treatment and so that the content level of carbon is reduced by at least 29% from the content level of carbon in the nickel powder obtained in the water-washing treatment.

4. The method of producing nickel powder having low carbon and sulfur concentrations according to claim 1, wherein the roasting treatment is carried out so that the content level of sulfur is reduced by at least 75% from the content level of sulfur in the nickel powder obtained in the water-washing treatment and so that the content level of carbon is reduced by at least 71% from the content level of carbon in the nickel powder obtained in the water-washing treatment.

* * * * *